United States Patent [19]

Lefler

[11] Patent Number: 4,765,764

[45] Date of Patent: Aug. 23, 1988

[54] KEYBOARD

[75] Inventor: Jerrold P. Lefler, Simi Valley, Calif.

[73] Assignee: Digitext, Inc., Thousand Oaks, Calif.

[21] Appl. No.: 832,273

[22] Filed: Feb. 20, 1986

[51] Int. Cl.[4] ..... B41J 5/10

[52] U.S. Cl. ..... 400/482; 400/91; 400/272; 400/473

[58] Field of Search ..... 400/91, 92, 93, 94, 400/482, 472, 473, 272; 178/21; 84/433; 235/145 R

[56] References Cited

U.S. PATENT DOCUMENTS

| | | | |
|---|---|---|---|
| 1,294,611 | 2/1919 | Bryan | 400/482 |
| 1,843,929 | 2/1932 | Parker | 400/482 |
| 2,319,273 | 5/1943 | Sterling | 400/91 X |
| 2,505,046 | 4/1950 | Holmes, Jr. | 400/482 |
| 3,557,927 | 1/1971 | Wright et al. | 400/94 |
| 3,558,820 | 1/1971 | Baisch et al. | 400/94 X |
| 3,970,185 | 7/1976 | Shelton | 400/482 |
| 4,370,970 | 12/1981 | McGaughey, Jr. et al. | 400/482 |

FOREIGN PATENT DOCUMENTS

| | | | |
|---|---|---|---|
| 2542888 | 9/1984 | France | 400/94 |
| 8103641 | 12/1981 | World Int. Prop. O. | 400/91 |
| 2122947 | 1/1984 | United Kingdom | 400/482 |

*Primary Examiner*—Edgar S. Burr
*Assistant Examiner*—James R. McDaniel
*Attorney, Agent, or Firm*—Nilsson, Robbins, Dalgarn, Berliner, Carson & Wurst

[57] ABSTRACT

A keyboard for use with a stenographic transcription and translating assembly possessing word processing capabilities having horizontal and vertical groupings of keys indicating the generation of signals characterizing consonant and vowel letters or non-phonetic language construction command instructions such as transcribing translation or word processing instructions.

6 Claims, 2 Drawing Sheets

FIG. 1
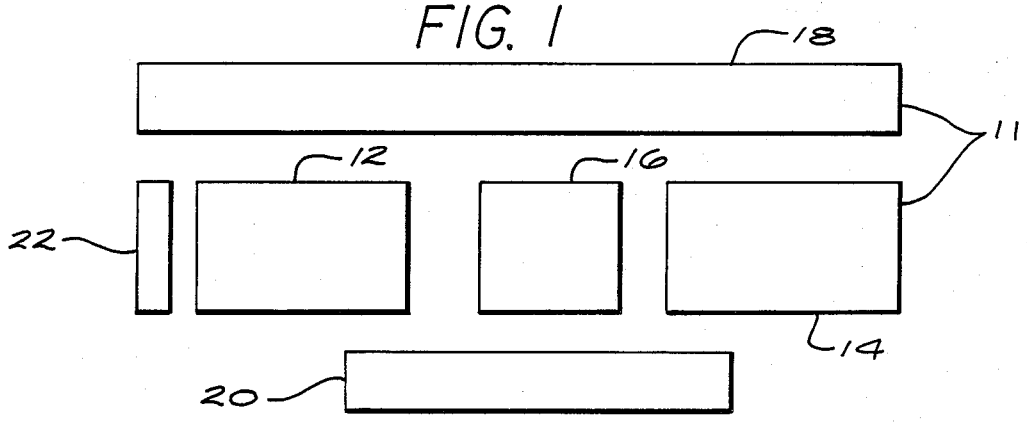
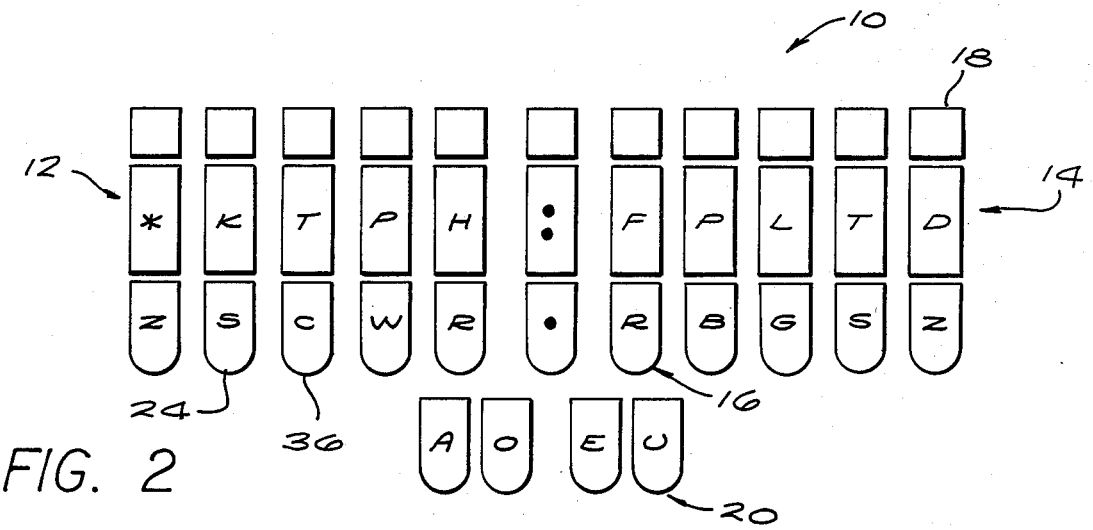
FIG. 2
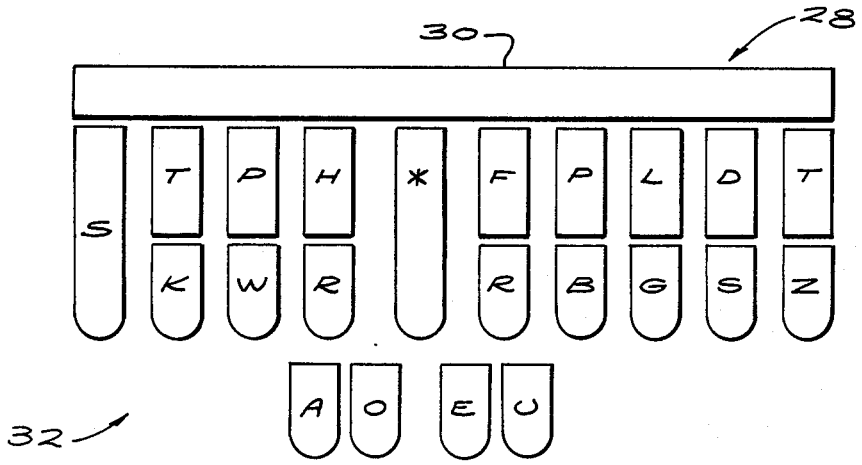
FIG. 3

KEYBOARD

BACKGROUND OF THE INVENTION

The present invention relates to a keyboard and specifically, to a computer translation compatible keyboard for use with a stenographic transcribing device.

Stenography is a widely used technique for transcribing verbal communication into written text. Stenography involves: (1) making a record of the verbal communication, and (2) translating the phonetic record into a readable language, such as English. The stenographer does the transcribing by either shorthand, or more typically by using a stenographic machine.

Generally, stenographic machines have keyboards of twenty-two character keys. The operator depresses the appropriate combinations of keys, either singularly or in combination, to phonetically record a stenographic equivalent of the word being transcribed. The record produced may be retained on a paper tape or on a magnetic medium, such as a computer disk. A general description of a machine of this type is disclosed in U.S. Pat. No. 2,319,273, entitled Stenographic Machine, issued to J. G. Sterling.

While stenographic machines provide an efficient and rapid means for recording verbal communication, translating the stenographic record to English is time consuming. The stenographer who performed the transcribing compiles the English translation by manually interpreting and reading the stenographic record.

Translation may be alternatively accomplished by later applying the stenographic record to a computer which translates the record to English. The computer is typically provided with a dictionary from which it matches the stenographic record to stored equivalents identifying the corresponding language words. An example of such a stenographic translator is disclosed in U.S. Pat. No. 3,557,927, entitled Stenographic Transcription System, issued to Wright et al on Jan. 26, 1971.

Heretofore, computer translators have been off line devices which were incapable of simultaneous, virtually instantaneous, translation. As such, conventional stenographic keyboards were not used to input word processing commands to the computer translator. Instead, conventional computer keyboards were used for editing after the computerized translation was completed.

The first real time translation system was devised by the inventor of the present keyboard and is described in U.S. patent application Ser. No. 795,944, filed Nov. 7, 1985, which application is incorporated by reference. This computerized translation system for the first time allowed real time translation and hence allows for the option of effecting word processing and control functions through a standard stenographic keyboard rather than a standard computer keyboard. However, the standard stenographic keyboard does not provide a key arrangement which allows for the recording of unambiguous words without defining special keystroke combinations which must be memorized by the operator. Also, the conventional stenographic keyboard does not provide independently any means for generating word processing or system commands. Consequently, special otherwise non-used, stroke combinations must be defined and memorized by the operator. This increases the complexity of utilizing a standard stenographic machine.

There are keyboard arrangements which may be used for transcribing verbal communication which are also compatible with word processors allowing the operator to access word processing functions, e.g. standard typewriter keyboards. These keyboards significantly differ from typical stenographic keyboards and are generally more cumbersome to use for stenography.

Another keyboard arrangement useful with an apparatus for transcribing and translating verbal discussions is disclosed in U.S. Pat. No. 3,558,820, entitled Stenographic Machine and System, issued to Baisch et al on Jan. 26, 1971. Again, the disclosed keyboard substantially differs from the typical stenographic keyboard. The Baisch keyboard provides numerous rows of keys arranged in both vertical and horizontal groupings. Each key grouping includes individual keys corresponding to a beginning vowel, beginning consonant, number, symbol, ending consonant, ending vowel or ending prefix. This keyboard possesses a greater number of keys than the standard stenographic keyboard requiring the stenographer to memorize the functions of numerous keys and concentrate on searching and depressing the specific key for a particular function.

There thus remains a need for a keyboard which closely resembles the simplicity and arrangement of standard stenographic keyboards, but is adaptable for use in a real time, computerized translation system to allow the stenographer, in conformance with a predefined stenographic stroking methodology, to more easily access word processing functions and enable unambiguous translation without the necessity of making multiple keystrokes.

SUMMARY OF THE INVENTION

A keyboard for use with a stenographic apparatus including a plurality of operable keys that generate signals relayed to a translating device, the generated signals characterize predefined groupings of letters or characterize instructions, the translating device is programmed by the operation of the keys to record a predefined word or instruction in response to the signals generated by the operation of one or more of the keys.

The invention is further directed to a keyboard assembly comprising:

first and second regions of individually and simultaneously operable keys for indicating the generation of signals characterizing predefined consonant letters;

a third region of individually and simultaneously operable keys for indicating the generation of signals characterizing predefined vowel letters;

fourth and fifth regions of individually and simultaneously operable keys which when singly or simultaneously depressed with other keys from one or more regions selected from the group consisting of said first, second and third regions indicate the generation of signals characterizing a command instruction or transcribing translation instruction; and a sixth region for indicating the generation of a signal instructing the negation of a previously generated signal.

BRIEF DESCRIPTION OF THE DRAWINGS

The present invention may be better understood and its numerous advantages will be apparent to those ordinarily skilled in the art by reference to the accompanying drawings, wherein like reference numerals refer to like elements of the several figures, in which:

FIG. 1 is a block diagram illustrating the positional arrangement of the key regions in accordance with a preferred embodiment;

FIG. 2 is a plan view of a keyboard arrangement in accordance with one embodiment of the invention;

FIG. 3 is a plan view of a conventional keyboard arrangement for a stenographic transcribing apparatus.

DESCRIPTION OF THE INVENTION

Figure 4:
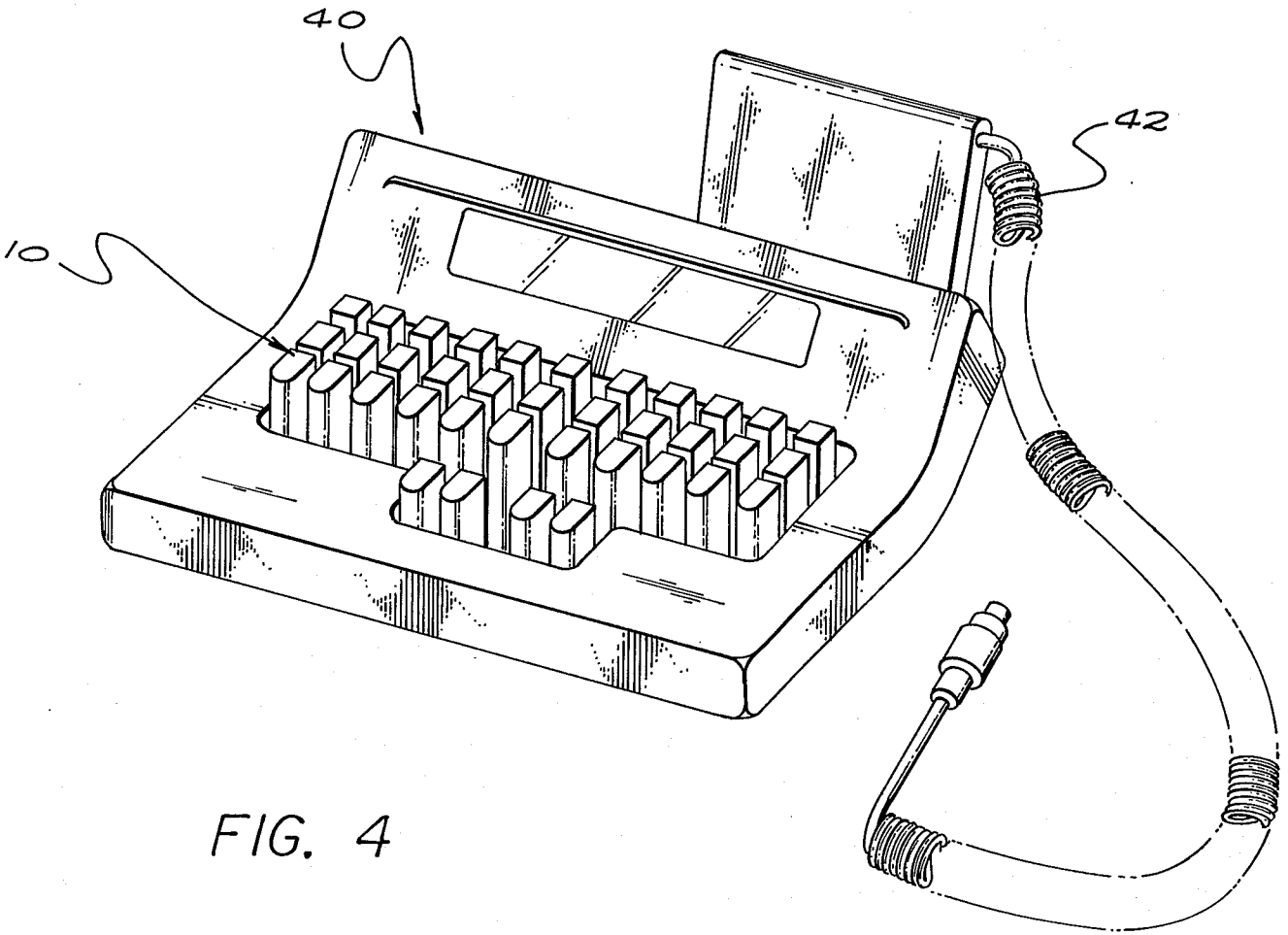
FIG. 4 is a perspective view of a stenographic transcribing and translating apparatus provided with a keyboard in accordance with the embodiment of FIG. 2.

The invention is directed to a keyboard which is incorporated in a transcription apparatus, such as a stenographic transcribing machine. The keyboard is connected to a signal generating device. The generated signals characterize predefined letters, groups of letters, numbers, groups of numbers or any other characterization which is desired. These signals are relayed to a computer translator programmed in accordance with a predefined stenographic methodology which prepares a written translated language text in accordance with the signals. The signals may also prescribe the initiation of computer activities, such as preprogrammed instructions for word processing, computer control or translation functions.

The configuration of the keyboard enables transcription of verbal or written communication, using a unique stenographic methodology, into a stenographic record. This methodology facilitates real time computer translation of the stenographic record. The configuration of this keyboard facilitates this unique stenographic methodology by adding and repositioning keys to a conventional stenographic transcribing machine. This keyboard enables an operator to generate both phonetic and non-phonetic representations not heretofore possible by depressing certain predefined keys. Specifically, the keyboard includes keys which represent, in the translation of words, silent letters or different phonetically equivalent sounding letters (e.g., "C" and "K") and also for allowing real time computer editing of the transcription.

The translation is performed by utilizing a dictionary, stored in memory, containing predefined meanings for the stenographic key strokes generated by the operation of the keyboard. Generally, the dictionary provides English words or word parts corresponding to the generated stroke symbols. The generation of stroke symbols results from depressing one or more keys with a complete word formed by one or more key strokes.

Referring to FIG. 1, a block diagram illustrating a keyboard 10 in accordance with the invention is shown. The keyboard 10 is comprised of different key regions 11 each defined by one or more keys. The keyboard 10 is incorporated into a stenographic transcribing and translating apparatus, such as seen in FIG. 4 at 40 which includes both the signal generating device and a computerized stenographic translating system. Keyboard 10 is particularly suitable for use with the predefined stenographic writing methodology as more fully set forth in the incorporated U.S. patent application Ser. No. 795,944. However, the keyboard in its broadest aspects can be used with other stenographic methodologies. The individual keys of the regions 11 are connected to a device which is capable of generating different signals corresponding to the depression of one or more keys. During transcription, the stenographer will depress a desired key or keys to generate a specific signal corresponding to a predefined phonetic or non-phonetic consonant or vowel arrangement or to some other predefined non-phonetic language construction instruction, such as translation or word processing instructions. The generated signal is relayed to the translating device which may record the relayed signals, translate the signals into a predefined language or both. The specific type of signal generating device and/or translating device and the manner of interconnecting the signal generating device and translating device is not critical to the invention. Any suitable signal generating device and translating device may be used with the keyboard 10.

Each region 11 contains a given number of keys which may be provided with indicia representing numerals, letters or other desired markings. An operator, by selectively depressing a key either individually or simultaneously with other keys, causes the generation of a signal indicating a predefined character or function. Specifically, the keyboard 11 is provided with two key regions 12 and 14 which possess an array of keys that indicate the generation of signals characterizing consonant letters and a key region 20 which possesses an array of keys that indicate the generation of signals characterizing vowel letters.

Keyboard 10 also includes a key 22 which upon depression generates a command instruction to negate selected previously generated signals; a key region 16 that generates, when only one of its keys is depressed with keys in regions 12, 14 or 20, an indication of a characteristic of the stroke translation, e.g., that it is a prefix; and, when both of its keys are simultaneously depressed with keys in regions 12, 14 or 20, provides a means of distinguishing between homonyms which would otherwise have identical strokes; and keys in region 18 which when depressed singly result in generation of commands for system control or word processing function and which when depressed in combination with one or more keys in regions 12, 14, or 20, result in predefined translation operations, such as letter doubling.

Preferably, the regions 11 of keyboard 10 are spatially positioned to allow a stenographer to transcribe using a commonly practiced stenographic technique. Generally, this technique positions both hands above the keyboard so that keys in the various regions 11 can be simultaneously operated. Four fingers of the left hand activate the keys in the first consonant letter region 12 with the four fingers of the right hand positioned to activate the keys in the second consonant letter region 14. In accordance with this standard stenographic technique, keys may be simultaneously depressed in the first consonant region 12 to record a consonant portion of the word being transcribed coming before a vowel portion in the word. Depression of keys in the second consonant letter region 14 record a consonant portion of the word, if any, following that vowel portion. A key or keys in the vowel letter region 20 may be simultaneously depressed with the thumb of either hand to record the vowel portion of the word being transcribed. Each simultaneous depression of various keys within different regions 11 is referred to as a key stroke. A word may be represented by a single key stroke or a group of key strokes depending upon the complexity of the word.

The particular functions of the keys in regions 16, 18 and 22 can be altered by appropriate software programming whereby the signal generated by depression of a key results in a particular predefined and preprogrammed function being performed. The keys in region 18 are preferably such that holding down the key will result in an automatic repetition of the signal.

In accordance with one preferred embodiment the command function key regions 16 and 18 contain individual keys which when depressed generate signals representing certain non-phonetic translation features. The keys in the command instruction key regions 16 and 18 may be depressed independently or combination with keys in the other regions 12, 14, or 20.

Preferably the depression of a key or keys only in region 18 initiate various preprogrammed word processing functions available on the particular computer system to which the keyboard 10 is connected. In accordance with the invention, "word processing" means the automated typing and text-editing abilities performed by suitable computer devices. The specific word processing functions are not critical to the invention. Suitable word processing functions include, but are not limited to universal word searching, deleting and inserting capabilities, and other text modification capabilities provided by computers.

To provide the user with easy access to the keys in the command instruction regions, region 18 is preferably juxtapositioned above both consonant letter key regions 12 and 14, with region 16 disposed between the consonant letter regions 12, 14 and 16. This allows the user to simultaneously depress the keys in either of the command instruction regions 16 and 18 with keys in the other regions 12, 14 and 20.

The keyboard 10 of the invention is also provided with a key 22 for negating a signal previously made during the transcription. While the signal negation indicating region 22 may be located anywhere on keyboard 10 it is preferably disposed adjacent to the first consonant letter region 12 as illustrated.

Referring now to FIGS. 2 and 3, a keyboard 10 in accordance with a preferred embodiment of the invention is shown. Keyboard 10 contains individual keys divided between regions 12, 14, 16, 18 and 20. Preferably, keyboard 10 will have thirty-seven keys. First consonant letter region 12 includes two horizontally parallel rows of nine individual keys with four keys in the upper row and five in the lower. This region is different from a conventional keyboard as illustrated in FIG. 3 in that the joined "S" key is divided into a lower row "S" and an upper row "K", the lower row "K" key in the conventional keyboard is changed to a "C" key, and a lower row "Z" is added next to the "S" key in keyboard 10 of the invention.

Second consonant letter region 14 includes two horizontally parallel rows of five individually operable keys. This region differs from the conventional keyboard of FIG. 3 in that the "F" key is changed to a "V" key with the key immediately above the "V" key in region 18 being designated as the "F" key.

Vowel letter region 20 includes a single horizontal row of four individual keys and remains unchanged from the conventional keyboard of FIG. 3.

Command instruction region 18 includes a single horizontal row having eleven individually operable keys. When one of the keys in region 18 is held down, the signal preferably automatically repeats at predefined and preprogrammed intervals. Region 18 with eleven keys replaces a single "#" bar which when depressed with another key would indicate a numeral. The preferred indicia provided the keys in region 18 are as illustrated in FIG. 2.

Command instruction region 16 has two vertically arranged keys. As illustrated in comparing FIGS. 2 and 3, these two keys replace a single "*" key in the conventional keyboard of FIG. 3.

Signal negation indicating region 22 has one key disposed in alignment with the upper row of keys of region 12, above the fifth additional "Z" key in the lower row and has no corresponding key in the conventional keyboard.

The correspondence between most keys on the present keyboard and the conventional keyboard allows a stenographer trained on conventional keyboards to easily adjust to the use of keyboard 10 of the present invention.

As above stated, the single "S" key on a conventional keyboard 28 is replaced by two keys, one upper "K" key and one lower "S" key. The "K" key of the conventional keyboard is changed to a "C" key. Since the "C" sound and "K" sound are phonetically equivalent and the conventional keyboard possessed only a "K" key, the stenographer had to differentiate between a "K" spelling or a "C" spelling from the context of the record during the editing process because of this ambiguity. Such ambiguities are virtually impossible to resolve with computer translation because they rely on analysis of the context of the record. Providing both a "C" key and a "K" key eliminates this ambiguity between the phonetically equivalent sounds of "K" and "C", removes the ambiguity found in the conventional stroking methodology and enable unambiguous and accurate computer translation. Further, the "K" key can be used to unambiguously record the non-phonetic silent "K" in words such as "knife".

The added "Z" key enables unambiguous recording of an initial "Z" letter. Heretofore, the "Z" sound which is phonetically equivalent to the "S" sound was recorded using the "S" key creating an ambiguity in the stenographic record.

With reference to the left or second consonant letter region 14, the "F" key of the conventional keyboard 28 is replaced by a "V" and one of the keys in the region 18 is designated as an "F" key. Like initially occurring "Z" and "S" sounds, the "V" and "F" sounds are sufficiently equivalent with only one key—the "F" key—used to represent that sound in the conventional keyboard. This resulted in an ambiguous record where the ambiguity had to be resolved manually translating from the context during the editing process. Resolving ambiguities from an analysis of the record context is virtually impossible with present computer capabilities and hence must be done manually. According to the stenographic system disclosed in the incorporated patent application, when the "F" key 24 is depressed with other keys, the translator will first search through a look up table dictionary in which all words having a single occurring "F" has been stored. If a match is found, then translation occurs. If no match is found, the stroke including the "F" is translated and presumed to be a word part and is translated with reference to a scan chart (as described in the incorporated application) with the "F" automatically doubled.

As previously stated, the single "*" key in the conventional keyboard of FIG. 3 is replaced by two keys designated as a "." key and a ":" key in region 16 of the keyboard 10 of the invention. In the preferred stenographic methodology as described in U.S. patent application Ser. No. 795,944, when either key in region 16 is depressed singly, the stenographic translator identifies the stroke in which the "." record or the ":" record occurs as being a prefix.

The use of both keys of region 16 in a keystroke allows the translator to distinguish between homonymous words to thereby eliminate yet another source of ambiguity in the stenographic record so as to make it compatible with computer translation techniques. This allows for the differentiation between two phonetically equivalent homonymous words otherwise having the same key stroke. The function of these keys in region 16 has particular applicability with the transcribing and translating system disclosed in the incorporated U.S. patent application Ser. No. 795,944, filed Nov. 7, 1985.

In particular, the incorporated patent application discloses a translator which possess a standard dictionary and a "scan chart". The translating device compares one or more generated keystrokes with a list of keystrokes and their associated translations stored in the dictionary. If there is a match of keystrokes in the dictionary, then the translating device prints the stored word corresponding to those keystrokes. If the keystrokes do not have a match in the dictionary, the translating device enters the scan chart. The scan chart contains the word part translation of single keystrokes. The translating device matches each untranslated keystroke with a keystroke in the scan chart and combines the resulting translation to form words from these word parts in accordance with a defined set of preprogrammed construction rules which identify the word part as a prefix, suffix or word root. It has been found that most words can be translated using the scan chart and the construction rules, with the dictionary containing words which cannot be translated. The translation of keystrokes identified as prefixes, suffixes and word parts are easily combined to form words. A keystroke including one of the keys of region 16 allows the operator to designate a word part as a prefix. This has been found to significantly reduce the size of the dictionary to be provided the translating device and enable great flexibility. For example, the present keyboard and stenographic system enables names to be written without specially storing them in a job dictionary. To illustrate, there is no way to write the name "Duncan" using a conventional keyboard without pre-storing a special keystroke for "Duncan" in a job dictionary. Using the present keyboard and stenography system, however, "Duncan" can be easily written unambiguously and without predefinition. The strokes are

| | prefix ↑ | | | | | |
|---|---|---|---|---|---|---|
| TK | . | U | PB | C | A | PB |
| ↓ | | ↓ | ↓ | ↓ | ↓ | ↓ |
| D | | U | N | C | A | N |

It will be appreciated that one of the most significant slowing factors in stenographic recording is the recording of names and addresses. This slowing factor can be eliminated by the present keyboard.

In accordance with the preprogrammed constructions rules when a keystroke includes a vowel preceeded by a consonant, the keystroke is read as a prefix if the untranslated keystroke matches a keystroke in the scan chart. However, under certain circumstances the translating of the keystroke in this manner is incorrect. Accordingly, by including a key from region 16 in the keystroke the resulting translation is an independent word, and not a prefix. For example, the keystroke for the French word "Le" would be translated as a prefix in accordance with the construction rules and the scan chart. When a key from region 16 is included in the keystroke the resulting translation is a separate word "Le". Thus, the keystroke "Le" will be read as a prefix while "Le." will be read as an independent word.

Depression of the keys of region 18 generate command signals when depressed singularly. However, when a key or keys of region 18 are depressed with a key in regions 12, 14 or 20 a means is provided for indicating a non-phonetic translation characteristic. For example, the stenographic system can be programmed so that if the "PP", "LL" or "DD" keys of region 18 are depressed with any consonant in the second region 14, then that consonant is doubled. If the stroke has an ending vowel (region 20) key and "PP", "LL", "TT" or "DD" is depressed as part of the stroke then the translator will double the "P", "L", "T" or "D", respectively in the translation of the stroke. There is no way of achieving this doubling feature with the conventional keyboard. Consequently, the word part "bil" and the word "bill", for example, are indistinguishable with a keyboard such as that of FIG. 3 without adding strokes, or resolving the ambiguity during editing. Analogously, any stroke which includes a "DBL" key will cause the translator to double the last letter of the translation.

Finally, it is preferred that the depression of the two keys in region 18 adjacent the "P" and "L" keys of region 14 indicate the generation of a signal characterizing the letters "mb". This provides for the unambiguous translation of the silent "b" in such words as "bomb", which heretofore would require an editing of the completed translation to determine the silent "b" or require the operator to initiate multiple keystrokes.

It will be appreciated that while specific key arrangements and designations have been discussed above in relationship to the specific translation system as set forth in U.S. patent application Ser. No. 795,944 filed Nov. 7, 1985, that the present keyboard of the invention has substantial flexibility when used in cooperation with a computerized translation system. Specifically, the function of individual keys can be redefined and indeed reprogrammed so that a command function of one key can be changed by simply altering the software of the translator. As set forth in the above referenced patent application, this can be done by the "personal dictionary" alteration technique whereby changes in key functions can be simply programmed through the keyboard itself. Furthermore, the keyboard of the invention may also act as a calculator keyboard by altering the mode of translating via the programming. For example, referring to FIGS. 2 and 4, the "F", "PP", "LL", "V", "P", "L", "R", "B", "G", "E" and "U" indicated keys can be designated as the numerals 1, 2, 3, 4, 5, 6, 7, 8, 9, 00 and 0, respectively, allowing the stenographic keyboard to act as a conventional calculator. The mode shift can be preprogrammed in any suitable way, but may, for example, be enabled by depressing the "*" key and holding that key down for a designated length of time, which will be detected by the translator as shifting from the stenographic translation mode to the calculator input mode.

While the preferred embodiments have been described and illustrated, various modifications and substitutions can be made thereto without departing from the scope of the invention. Accordingly, it is to be understood that the present invention has been described by way of illustration and not limitation.

What is claimed is:

1. A stenographic keyboard for generating unique, computer readable and translatable signals to provide unambiguous and context independent translation of a stenographic record comprising, from bottom to top:

a lower row of four vowel keys, which from left to right are A O E U;

a lower middle row of keys arranged to define a first left hand group, a first center group and a first right hand group, the first left hand group keys, from left to right are Z, S, C, W, R, the first center group defining a first stroke ambiguity resolution key, and the first right hand group of keys, from left to right, are R, B, G, S, Z;

an upper middle row of keys arranged to define a second left hand group, a second center group and a second right hand group, the second left hand group of keys from left to right are "first control key", K, T, P, H, the second center group defining a second stroke ambiguity resolution key and the second right hand group of key, from left to right are V, P, L, T, D; and a top row of individually operable keys defining control keys for controlling computers in a first mode and defining ambiguity resolution keys for resolving stroking ambiguities in a second mode.

2. The stenographic keyboard of claim 1 wherein each top row key is aligned above an upper middle row key, the top row key aligned above the V key being, in the second mode, an F, and the top row key aligned above the P, L, T and D keys being, in the second mode, a PP, LL, TT and DD key, respectively.

3. The stenographic keyboard of claims 1 or 2 wherein each of the top row keys is, in the second mode, a "double letter key" which when depressed with another letter key from the bottom, lower middle, upper middle or top rows causes such other letter to be doubled in translation.

4. The stenographic keyboard of claims 1 or 2 wherein the first and second ambiguity resolution keys are coupled so that the simultaneous depression of either the first or second ambiguity resolution key with one or more other letter keys defining a stroke identifies the stroke as being a prefix, and the simultaneous depression of both the first and second ambiguity resolution keys with one or more other letter keys defining a stroke distinguishes the translation of said stroke from its homonym.

5. The stenographic keyboard of claim 3 wherein the first and second ambiguity resolution keys are coupled so that the simultaneous depression of either the first or second ambiguity resolution key with one or more other letter keys defining a stroke identifies the stroke as being a prefix, and the simultaneous depression of both the first and second ambiguity resolution keys with one or more other letter keys defining a stroke distinguishes the translation of said stroke from its homonym.

6. The stenographic keyboard of claims 1 or 2 wherein the "first control key" defines a "cancel" key which, when depressed singly, deletes the key stroke immediately preceding.

* * * * *

UNITED STATES PATENT AND TRADEMARK OFFICE

CERTIFICATE OF CORRECTION

PATENT NO. : 4,765,764

DATED : AUGUST 23, 1988

INVENTOR(S) : JERROLD P. LEFLER

It is certified that error appears in the above-identified patent and that said Letters Patent is hereby corrected as shown below:

Column 10, line 4, "each" should be --one--.

Signed and Sealed this

Twenty-fourth Day of January, 1989

*Attest:*

DONALD J. QUIGG

*Attesting Officer*

*Commissioner of Patents and Trademarks*